US007150610B2

(12) United States Patent
Takahashi et al.

(10) Patent No.: US 7,150,610 B2
(45) Date of Patent: Dec. 19, 2006

(54) GAS COMPRESSOR

(75) Inventors: Toru Takahashi, Chiba (JP); Okikazu Kuwahara, Chiba (JP); Keiichi Morita, Chiba (JP)

(73) Assignee: Calsonic Compressor Inc. (JP)

( * ) Notice: Subject to any disclaimer, the term of this patent is extended or adjusted under 35 U.S.C. 154(b) by 94 days.

(21) Appl. No.: 10/644,709

(22) Filed: Aug. 20, 2003

(65) Prior Publication Data

US 2004/0136841 A1 Jul. 15, 2004

(30) Foreign Application Priority Data

Aug. 30, 2002 (JP) ..... 2002-253743

(51) Int. Cl.
*F03C 2/00* (2006.01)
*F04C 2/00* (2006.01)

(52) U.S. Cl. ..... 418/76; 418/82; 418/93; 418/268

(58) Field of Classification Search ..... 418/76, 418/82, 93, 96–98, 268, 270, DIG. 1
See application file for complete search history.

(56) References Cited

U.S. PATENT DOCUMENTS 4,144,002 A * 3/1979 Shibuya et al. ..... 418/76
4,507,065 A * 3/1985 Shibuya et al. ..... 418/268
4,538,976 A * 9/1985 Shibuya ..... 418/269
4,653,991 A * 3/1987 Takao et al. ..... 418/268
4,810,177 A * 3/1989 Shibuya et al. ..... 418/268
5,411,385 A * 5/1995 Eto et al. ..... 418/98
6,851,940 B1 * 2/2005 Ono ..... 418/97

OTHER PUBLICATIONS

Patent Abstracts of Japan vol. 009, No. 311 (M-436), Dec. 7, 1985 & JP 60 145476 A (Matsushita Denki Sangyo KK), Jul. 31, 1985.
Patent Abstracts of Japan vol. 010, No. 006 (Jan. 11, 1986) & JP 60 169688 A (Atsugi Jidoushiya Buhin KK), Sep. 3, 1985.
Patent Abstracts of Japan vol. 0091, No. 62 (M-394), Jul. 6, 1985 & JP 60 035193 A (Seiko Seiki KK), Feb. 22, 1985.
Patent Abstracts of Japan vol. 2002, No. 2, Apr. 2, 2002 & JP 2001 271771 A (Seiko Instruments Inc), Oct. 5, 2001.

* cited by examiner

*Primary Examiner*—Theresa Trieu
(74) *Attorney, Agent, or Firm*—Adams & Wilks

(57) ABSTRACT

To reduce an excessively high vane back pressure to an appropriate pressure to thereby relieve operational load, and to improve the vane projectability at the start and during low speed operation to thereby prevent chattering; There are provided back pressure spaces including the bottom portion of vane grooves and attaining a middle pressure between suction pressure and discharge pressure during normal operation of the compressor main body, a first high pressure oil passage establishing communication between an oil sump and the vane groove bottom portions when the vanes are in their discharge stroke positions, second high pressure oil passages establishing communication between the oil sump and the back pressure spaces, and an opening/closing valve for opening and closing the second high pressure oil passages.

17 Claims, 12 Drawing Sheets

GAS COMPRESSOR

BACKGROUND OF THE INVENTION

1. Field of the Invention

The present invention relates to a gas compressor suitable for automotive air conditioning or the like and adapted to suck, compress, and discharge refrigerant gas.

2. Description of the Related Art

FIGS. 10 and 11 show an example of a gas compressor for use in automotive air conditioning or the like. This compressor is equipped with a cylinder 5 with an elliptical inner periphery, and a front side block 6 and a rear side block 7 arranged at the axial ends of the cylinder 5. Inside the cylinder 5, a rotor 11 is arranged so as to be rotatable around a rotor shaft 10. A plurality of vane grooves 12 are formed so as to extend from the outer peripheral surface to the inner periphery of the rotor 11, and vanes 15 are respectively accommodated in the vane grooves 12 so as to be capable of projecting from and retracting into the vane grooves. Formed at the bottom portion (inner peripheral side) of each vane groove 12 is a back pressure chamber 14 to which pressure fluid is supplied. The vanes 15 are caused to project toward the outer periphery by the pressure of the pressure fluid supplied to the back pressure chambers 14 and the centrifugal force generated by the rotation of the rotor 11, slidably abutting the inner peripheral surface of the cylinder. In this way, the outer peripheral surface of the rotor 11, the vanes 15 projecting from the outer peripheral surface of the rotor 11 to abut the inner surface of the cylinder, and the inner peripheral surface of the cylinder 5 define a plurality of cylinder compression chambers 16. This is how the compressor main body is constructed.

In the above gas compressor, when the rotor 11 is rotated around the rotor shaft 10, the volume of the cylinder compression chambers 16 is varied, thereby compressing refrigerant gas in the cylinder compression chambers 16. The compressed refrigerant is discharged from the cylinder compression chambers 16 into an oil separating block 25. In the course of its suction, compression, and discharge, the refrigerant gas gets mixed with oil inside the gas compressor, and is discharged into the oil separating block 25 while containing the oil, which is separated from the refrigerant gas by an oil separator 26 provided in the oil separating block 25. The separated oil is dripped into an oil sump 30 to stay therein, and the compressed gas from which the oil has been removed is discharged into a second discharge chamber 8. Due to the difference in pressure inside the compressor, some of the oil in the oil sump 30 is sent under pressure through an oil passage 31, etc. to the sliding portions of the cylinder compression chambers 16 to prevent wear and effect sealing by means of oil film. Further, part of the oil is supplied to the back pressure chambers 14 as pressure fluid.

In supplying oil to the back pressure chambers 14, the vane back pressure is controlled in the course of suction, compression, and discharge strokes such that the vane back pressure is at middle pressure from the suction to compression stroke and high pressure in the discharge stroke. The reason for this is as follows. During the period in which the compression of the refrigerant gas trapped in the cylinder compression chambers 16 by means of the vanes 15 is so progressed as to attain the discharging stage, that is, in the discharge process, a strong force due to the increase in the pressure of the refrigerant gas in the cylinder compression chambers 16 is exerted so as to push the vanes 15 back toward the interior of the vane grooves 12. Thus, it is necessary to apply high pressure to the back pressure chambers 14 to press the vanes 15 reliably against the inner surface of the cylinder 5. On the other hand, during the period in which there is no need to impart a pushing out or an extruding force to the vanes 15 by means of high back pressure, that is, from the suction to the compression process, imparting large pressure to the vanes 15 only results in an increase in the rotation load of the rotor 11, which is of no use. During this period, the pressure imparted to the vanes 15 is reduced to reduce the rotation load of the rotor 11.

Thus, as shown in FIG. 11, there are provided in the end surface of the rear side block 7 flat groove portions 17 corresponding in position and configuration to the back pressure chambers 14 of the vanes 15 in transition from the suction stroke to the compression stroke, and oil is supplied to the flat groove portions 17 after being throttled by a bearing, etc. and reduced to a middle pressure. By supplying oil at middle pressure to the back pressure chambers 14 through the flat groove portions 17, the back pressure chambers 14 are maintained at the middle pressure, thus preventing a pressure more than necessary from being applied to the vanes 15, whereby it is possible to reduce the power burden, and, in the case of a compressor mounted in a vehicle, it is possible to achieve an improvement in terms of fuel efficiency.

Further, in the end surface of the rear side block 7, there are formed high pressure oil supplying holes 18 corresponding in position and configuration to the back pressure chambers 14 of the vanes 15 in the discharge stroke, and high pressure oil which has not been throttled is supplied to the high pressure oil supplying holes 18 through the oil passage 31. Thus, high pressure oil is supplied from the high pressure oil supplying holes 18 to the back pressure chambers 14. Due to the supply of the high pressure oil to the back pressure chambers 14 through the high pressure oil supplying holes 18, high pressure is maintained in the back pressure chambers 14, and high pressure is imparted to the vanes 15, thereby reliably bringing the vanes 15 into contact with the inner surface of the cylinder 5.

Incidentally, the flat groove portions 17 and the high pressure oil supplying holes 18 are situated such that communication is temporarily established therebetween through the back pressure chambers 14 as the rotor 11 rotates. Thus, even after the communication between them is canceled, the pressure of the high pressure oil remains in the flat groove portions 17, so that the pressure in the back pressure chambers 14 is kept high even in the suction and compression strokes, which means the power reducing effect cannot be achieved to a sufficient degree. To cope with this, a design has been made in which, as shown in FIG. 12, high pressure oil supplying holes **18*a* are arranged in a positional relationship such that no communication is established with the flat groove portions 17 through the back pressure chambers 14 so that the influence of the high pressure oil in the high pressure oil supplying holes may not be exerted on the flat groove portions 17. Due to this improvement, there is no fear of the high pressure oil supplied from the high pressure oil supplying holes 18*a* flowing directly into the flat groove portions 17, whereby the pressure in the back pressure chambers 14** is reduced to a sufficient degree in the suction and compression strokes, making it possible to reliably obtain the power consumption reduction effect during normal operation.

The above-described construction designed such that no communication is established between the flat groove portions and the high pressure oil supplying holes through the vane back pressure chambers involves no excessive increase in the vane back pressure in the suction and compression strokes, so that it is a satisfactory construction from the viewpoint of power reduction for the gas compressor. However, the oil in the compressor attains high pressure under the pressure of the discharge gas compressed in the gas compressor, so that, at the start of the gas compressor, the pressure of the discharge gas is not raised immediately, with the oil pressure being low. The oil supplied to the back pressure chambers in the suction and compression strokes further undergoes pressure reduction through the bearing, etc. to attain a still lower pressure. When, as is the case such as immediately after its mounting, the gas compressor is started with the vanes staying inside the vane grooves, it is necessary to push out the vanes by using the vane back pressure before the vane can be projected from the vane grooves overcoming the resistance of the oil film. However, in the above-described conventional construction, in which the vane back pressure is kept at a low level, the extruding or pushing out force during the period in which the oil pressure has not been increased to a sufficient degree yet, is insufficient, so that it may take time for the vanes to be projected. And, during the period in which the vanes have not been projected yet, normal compressing operation is not conducted, so that as long as the above phenomenon persists, the gas compressor cannot function as such. Further, there is the problem of noise (chattering) due to the collision of the vanes, slightly protruding from the outer periphery of the rotor, with the cylinder before the projection of the vanes.

Further, depending on the running condition of the vehicle, etc., when the gas compressor is operated continuously such that the rotor rotates at low speed, it is impossible to impart sufficient pressure to the vane back pressure chambers due to the low speed rotation. Further, in this state, the pressure of the refrigerant gas applied to the forward ends of the vanes overcomes the vane extruding force to push back the vanes (or the chattering limit is exceeded), and the vanes hit the cylinder inner surface as the rotor rotates, thereby generating colliding sound. It might be possible to cope with this problem by adjusting the vane back pressure in accordance with the chattering limit (increasing the pressure when imparting low pressure). However, increasing the pressure at the time of imparting low pressure would result in a deterioration in the above-mentioned power reducing effect.

SUMMARY OF THE INVENTION

The present invention has been made in view of the above problems. It is an object of the present invention to provide a gas compressor which supplies sufficiently high pressure to the back pressure chambers at the start or during low speed operation to thereby improve the vane projectability and which makes it possible to supply low pressure during normal operation to thereby obtain a power reducing effect.

To solve the above-mentioned problems, according to the present invention, the invention relates to a gas compressor having a compressor main body which sucks, compresses, and discharges refrigerant gas, and an oil sump which stores oil for lubricating the compressor main body, the compressor main body being composed of a cylinder, side blocks arranged at axial ends of the cylinder, a rotor rotatably arranged in the cylinder, vane grooves formed so as to extend from an outer peripheral surface of the rotor toward an inner periphery thereof, and vanes slidably accommodated in the vane grooves for undergoing advancing and retracting movement. The gas compressor has a back pressure space including the bottom portions of the vane grooves and attaining middle pressure between a suction pressure and a discharge pressure during a normal operation of the compressor main body; a first high pressure oil passage establishing communication between the oil sump and the vane groove bottom portions when the vanes are at their discharge stroke positions; a second high pressure oil passage establishing communication between the oil sump and the back pressure space; and an opening/closing valve for opening and closing the second high pressure oil passage.

According to the gas compressor of the present invention, the opening/closing valve keeps the second high pressure oil passage open when the rotation of the compressor main body is at rest, closes the second high pressure oil passage when the compressor main body starts rotation, and keeps the second high pressure oil passage closed during a normal operation of the compressor main body.

According to the gas compressor of the present invention, the opening/closing valve keeps the second high pressure oil passage closed during the normal operation of the compressor main body and keeps it open when the compressor main body is not performing the normal operation and the oil pressure is low.

According to the gas compressor of the present invention, the back pressure space has a flat groove communicating with the vane groove bottom portions when the vanes are at their positions in transition from suction to compression stroke, and that the vane groove bottom portions communicate with the first high pressure oil passage after the communication between the flat groove and the vane groove bottom portions is interrupted.

According to the gas compressor of the present invention, a downstream end portion of the second high pressure oil passage opens into the vane groove bottom portions, with the vanes being situated at their discharge stroke positions.

According to the gas compressor of the present invention, the downstream end portion of the second high pressure oil passage opens into the flat groove.

According to the gas compressor of the present invention, the opening/closing valve is movably arranged so as to open and close the second high pressure oil passage and has a valve element situated at a position where the valve element closes the flow passage and an elastic member capable of imparting an elastic force to the valve element to place the valve element at a position where the valve element opens the passage, the valve element moving under a pressure of high pressure oil to a position where the valve element closes the flow passage during normal operation of the compressor and moving to a position where the valve element opens the flow passage by the elastic force of the elastic member with the pressure of the high pressure oil being lowered.

Further, according to the gas compressor of the present invention, a differential pressure of the high pressure oil to which the discharge pressure in the compressor is imparted and a middle pressure oil is applied to the valve element.

That is, according to the present invention, in a state in which the oil pressure is not sufficiently high as in the case of starting, the opening/closing valve is opened, whereby high pressure fluid is supplied to the back pressure chambers through the second high pressure oil passage in the process of imparting middle pressure during normal operation. Thus, no matter what stroke the vanes are in, the pressure in the vane back pressure chambers increases to enhance the vane extruding force. This helps to improve the vane projectability at the start of the compressor, enabling the vanes to overcome the resistance of the oil film to quickly project from the vane grooves and making it possible to start normal compression at an early stage, whereby the operation of the air conditioning system is expedited, and cool air can be quickly provided. Further, due to the enhancement of the vane extruding force, the vanes are reliably brought into contact with the cylinder inner surface, and chattering caused by collision of vanes is prevented, thus achieving an improvement in terms of quietness for the vehicle in which the compressor is mounted.

On the other hand, in the operating state in which the oil pressure has been increased through normal operation, the opening/closing valve is closed, whereby no high pressure fluid is supplied to the back pressure chambers through the second high pressure oil passage. Thus, in the stroke requiring no large extruding force for the vanes, only oil at middle pressure is supplied to the back pressure chambers, and no excessively high pressure is imparted to the vane back pressure chambers. Thus, no excessive extruding force is applied to the vanes, so that it is possible to achieve a reduction in power load and an improvement in terms of fuel efficiency for the vehicle in which the compressor is mounted. Further, the wear of the vanes and the cylinder is mitigated, thus achieving an improvement in terms of parts durability. Further, in the stroke requiring a large extruding force for the vanes, high pressure is imparted to the back pressure chambers through the first high pressure oil passage, and the vanes are reliably brought into contact with the cylinder inner surface.

To achieve the above effects, it is desirable for the opening/closing valve to be one which is closed during normal operation and which is opened under an oil pressure not sufficiently high as is the case when starting the compressor or operating it at low speed.

Further, to supply high pressure oil to the back pressure chambers through the second high pressure oil passage in the stroke in which oil at middle pressure is supplied to the back pressure chambers, it is possible, for example, for the downstream end portion of the second high pressure oil passage to open into the bottom portions of the vane grooves in the discharge stroke or to open into the flat groove. And, as long as the above object can be achieved, there are no particular limitations regarding the construction for supplying fluid from the second high pressure oil passage to the back pressure chambers. Further, regarding the period in which high pressure oil is supplied to the back pressure chambers from the second high pressure passage, it need not cover the entire period of the stroke in which middle pressure oil is supplied to the back pressure chambers; it is only necessary for the period to cover at least a part of the stroke.

It is only necessary for the second high pressure oil passage to be one adapted to receive supply of high pressure oil from a high pressure oil supply source (oil sump or the like) in the gas compressor, and, regarding the position, etc. of the supply source, there are no particular limitations in the present invention. Further, it may also be one connected to the first high pressure oil passage to thereby receive supply of high pressure oil from that passage. Further, it is naturally possible for the second high pressure oil passage to be provided independently of the first high pressure oil passage. Further, it is possible for the second high pressure oil passage to be one connected to the space inside the cylinder to supply high pressure oil in the space inside the cylinder.

The above-mentioned middle pressure oil may be one obtained through passage of high pressure oil between the rotor shaft for rotating the rotor and the bearing rotatably supporting the rotor shaft.

Further, it is only necessary for the opening/closing valve to be one capable of opening and closing the second high pressure oil passage during normal operation and in the periods other than that, and there are no limitations in the present invention regarding its structure. While, as stated above, the structure of the opening/closing valve is not restricted to the above-described one, it may, for example, be preferably one in which the valve element thereof moves (slides or rotates) through appropriate balancing between the elastic force of the elastic member and the pressure of the high pressure oil (or the differential pressure of the high pressure oil and the middle pressure oil) to thereby open and close the above-mentioned passage.

The pressure of the high pressure oil varies according to the operating condition of the compressor main body, so that it is possible to perform opening/closing control on the opening/closing valve by setting the elastic force such that during normal operation, the pressure of the high pressure oil overcomes the elastic member and that in the conditions other than that, in which the pressure of the high pressure oil has not been increased to a sufficient degree yet, the elastic force of the elastic member is predominant.

Further, the differential pressure between the high pressure oil and the middle pressure oil also varies according to the operating condition of the compressor main body, so that it is possible to perform opening/closing control on the opening/closing valve according to the operating condition of the compressor main body by setting the elastic force such that during normal operation, the differential pressure is large enough to overcome the elastic force, and that in the conditions other than that, in which the oil pressure has not been increased to a sufficient degree yet, the differential pressure is so diminished as to be overcome by the elastic force of the elastic member. It is also possible to utilize the fluid supplied to the back pressure chambers as the high pressure oil and the middle pressure oil imparted to the opening/closing valve. Instead, it is also possible to use the fluid obtained within the gas compressor. Thus, the pressure of the fluid may also be different from the pressure of the fluid supplied to the back pressure chambers.

While a typical example of the elastic member is a coil spring, this should not be construed restrictively. Further, the compressive force, extension force, etc. of the elastic member may be appropriate ones, and there are not particular limitations regarding the mode in which it is used.

As described above, the gas compressor of the present invention includes a cylinder, side blocks arranged at the axial ends of the cylinder, a rotor rotatably arranged in the cylinder, vane grooves extending from the outer peripheral surface to the inner periphery of the rotor, vanes accommodated in the vane grooves so as to be capable of advancing and retracting, and back pressure chambers provided in the vane grooves and adapted to impart extruding force to the vanes. This is how the gas compressor main body is constructed. Apart from this, the gas compressor of the present invention may further include a suction chamber into which low pressure refrigerant gas is introduced, a suction passage through which the low pressure refrigerant gas is sucked into the cylinder compression chamber from the suction chamber, a discharge hole through which the compressed refrigerant gas is discharged from the cylinder compression chambers, a discharge chamber into which the refrigerant gas is discharged through the discharge hole, an oil sump receiving the pressure of the discharge chamber, and an oil communication passage communicating with the oil sump.

BRIEF DESCRIPTION OF THE DRAWINGS

FIG. 9A is a front sectional view showing in the closed state of the opening/closing valve, and FIG. 9B is a front sectional view showing in the open state of the opening/closing valve.

DESCRIPTION OF THE PREFERRED EMBODIMENT (First Embodiment)

Figure 10:
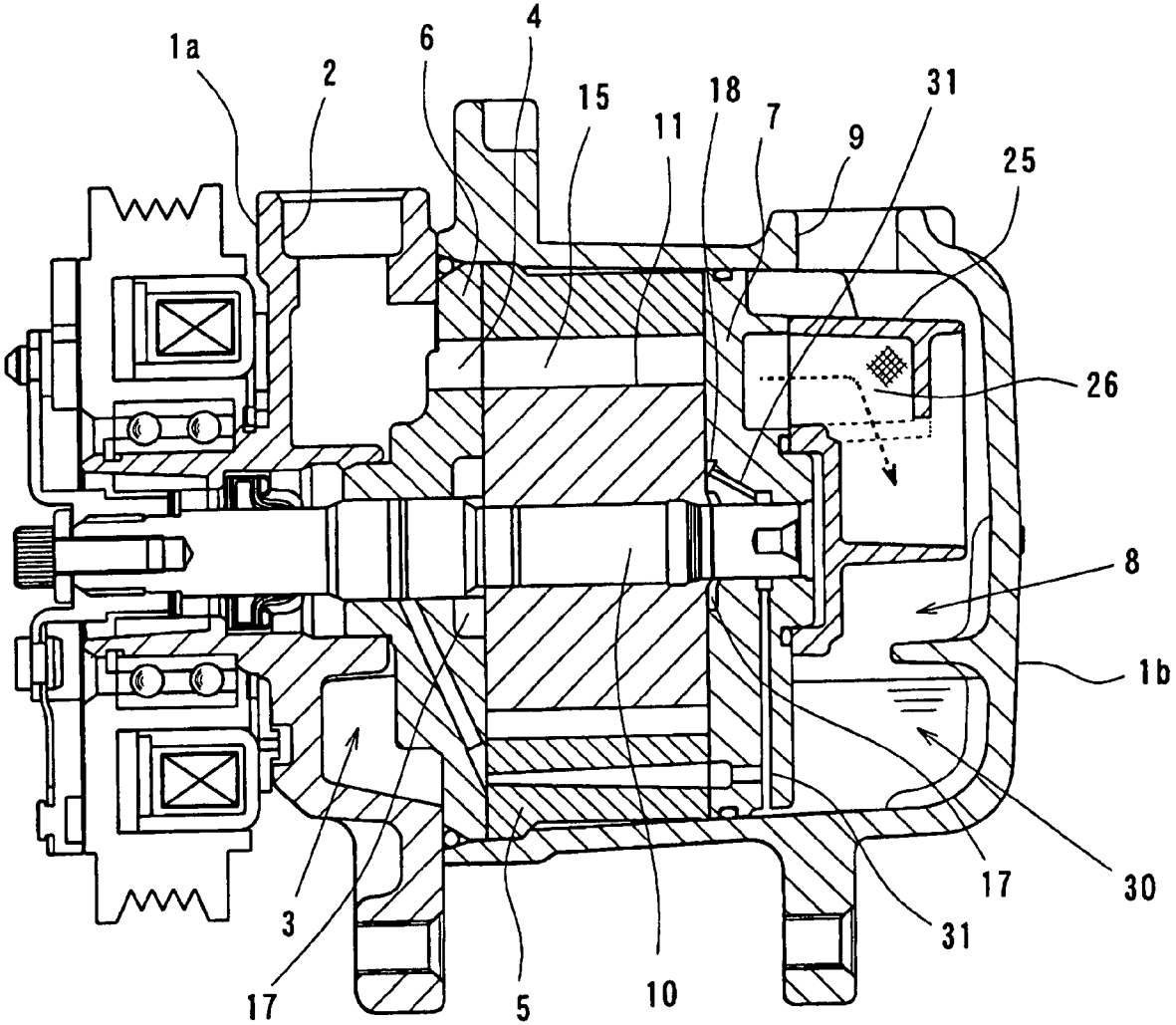
FIG. 10 PRIOR ART
FIG. 10 is a front sectional view showing the general construction of a conventional gas compressor.
Figure 11:
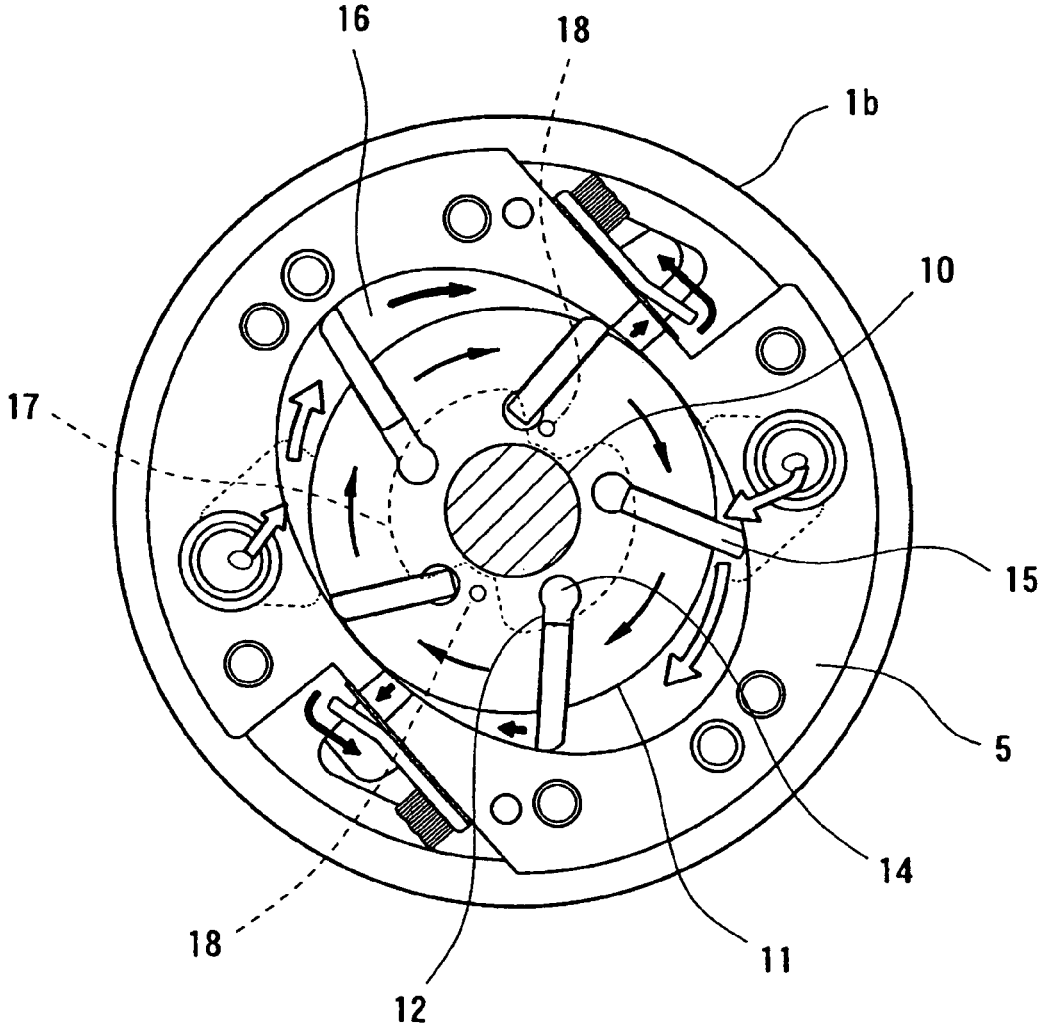
FIG. 11 PRIOR ART
FIG. 11 is a front side view of a compressor main body of the conventional gas compressor.
Figure 12:
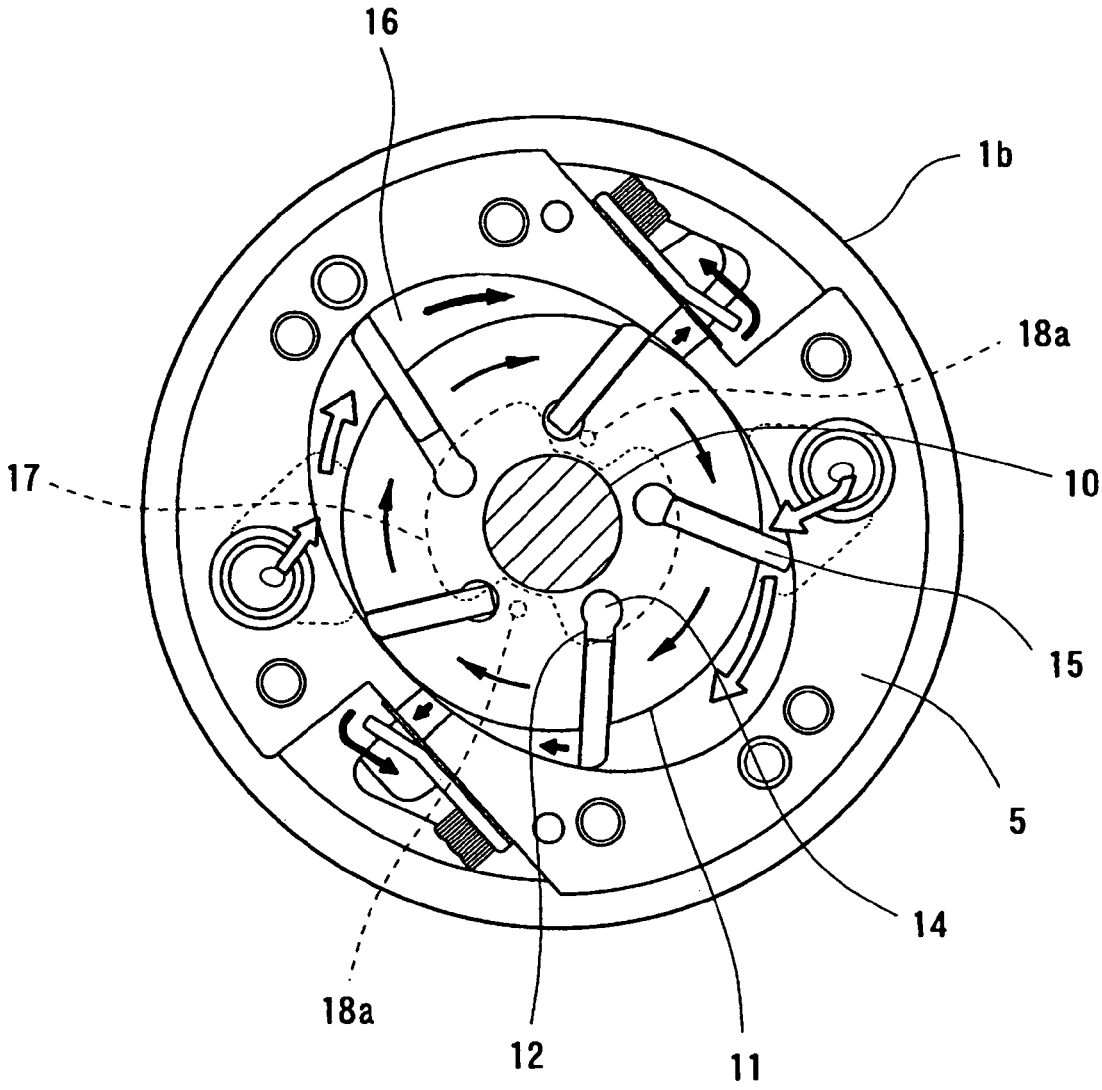
FIG. 12 PRIOR ART
FIG. 12 is a front side view of the main body of an improved conventional gas compressor.

In the following, a first embodiment of the present invention will be described with reference to FIGS. 1 through 6. The components which are the same as those of the prior art are indicated by the same reference numerals, and the general construction of the gas compressor will be described with reference to FIG. 10.

As in the conventional construction, the gas compressor of the present invention is equipped with a cylinder 5 with an elliptical inner periphery, and front and rear side blocks 6 and 7 arranged at the axial ends of the cylinder 5. A front housing 1*a* is mounted to the front side of the front side block 6, and a rear housing 1*b* is mounted so as to extend from the rear side of the rear side block 7 to the front side block 6. A suction port 2 is provided in the front housing 1*a*, and a suction chamber 3 is provided in the front housing 1*a* so as to communicate with the suction port 2.

Figure 1:
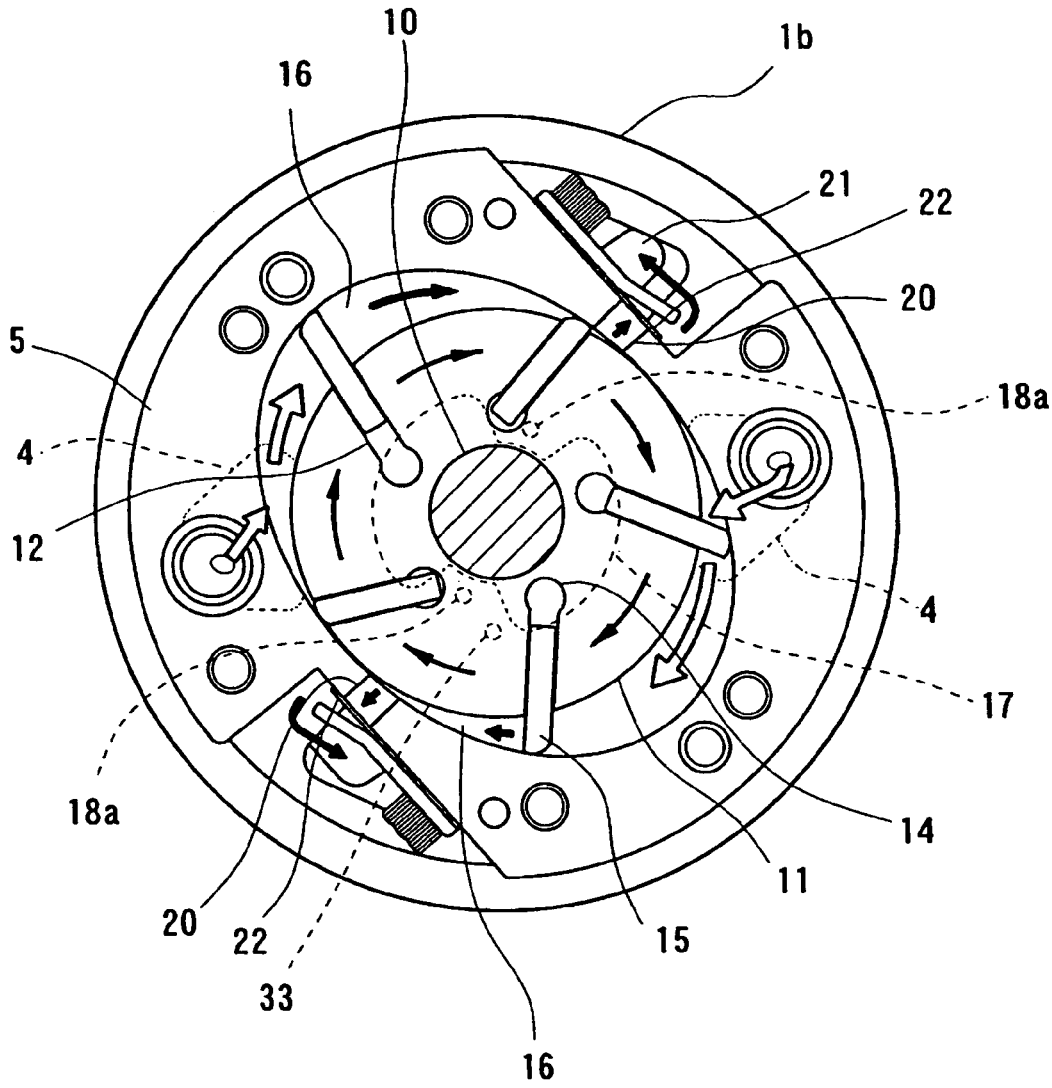
FIG. 1 is a front side view of a gas compressor in accordance with a first embodiment of the present invention.
Figure 2:
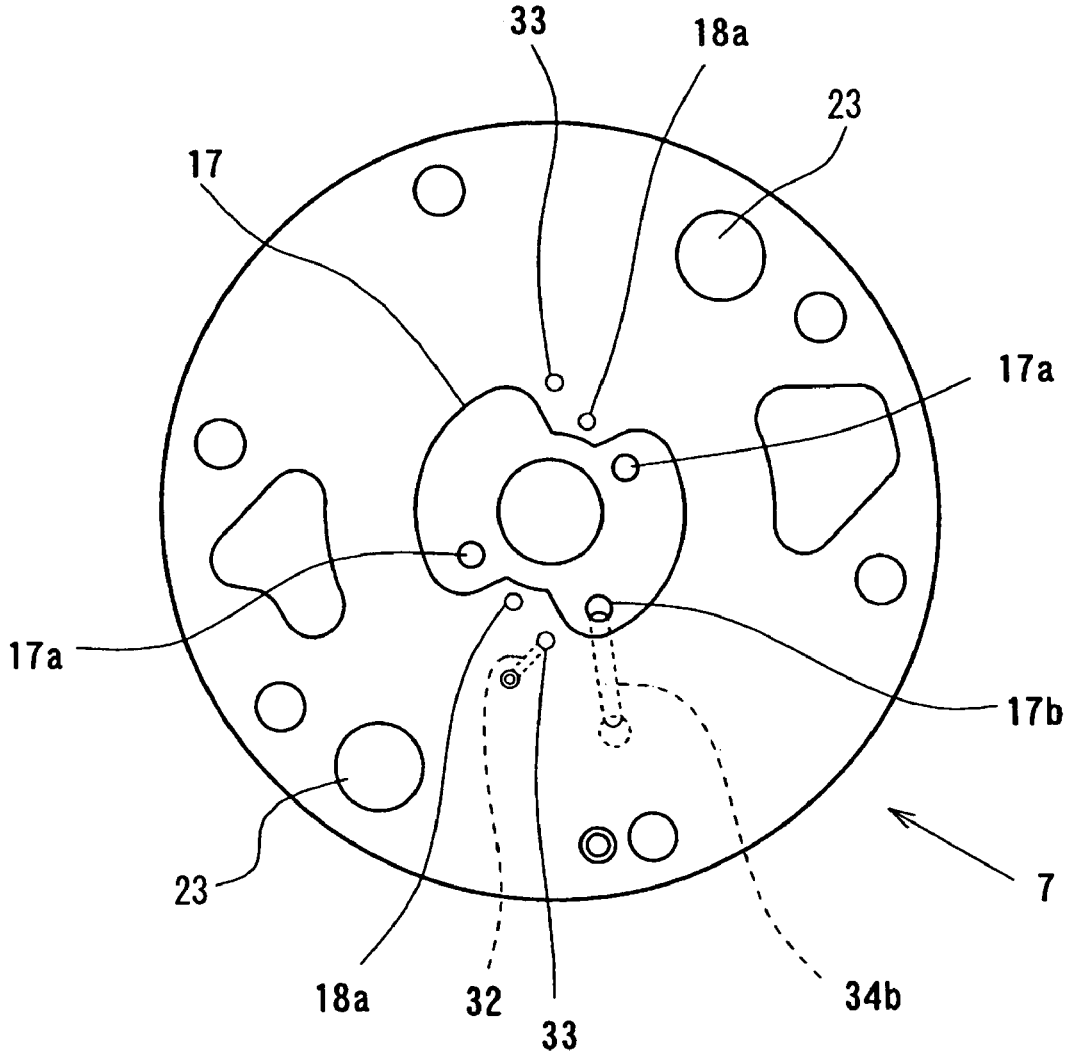
FIG. 2 is a side view of the inner side of a rear side block of the first embodiment of the present invention.

As shown in FIG. 1, a rotor 11 is arranged in the cylinder 5 so as to be rotatable around the rotor shaft 10. A plurality of vane grooves 12 are formed so as to extend inwardly from the outer peripheral surface toward the inner periphery of the rotor 11, with vanes 15 being slidably accommodated in the vane grooves 12 so as to be capable of projecting and retracting during rotation of the rotor 11. At the bottom portions (on the inner peripheral side) of the vane grooves 12, there are formed, as back pressure spaces, back pressure chambers 14 to which pressure fluid is supplied.

The cylinder compression chambers 16 communicate with the suction chamber 3 through the suction passage 4 formed in the front side block 6. Further, formed in the cylinder 5 is a discharge hole 20 communicating with the cylinder compression chambers 16, and a first discharge chamber 21 communicating with the discharge hole 20 is formed along the axial direction of the cylinder 5. Reference numeral 22 indicates a reed valve for opening and closing the discharge hole 20. The first discharge chamber 21 communicates with an oil separating block 25 provided on the rear side of the rear side block 7 through a discharge passage 23 formed in the rear side block 7 (see FIG. 2), with an oil separator 26 being provided in the oil separating block 25. Further, the space defined by the rear side block 7 and the interior of the rear housing 1*b* constitutes a second discharge chamber 8 into which compressed gas (refrigerant) is discharged, and an oil sump 30 is provided in the lower portion of the second discharge chamber 8.

The oil sump 30 communicates with an oil passage 31, which is arranged inside the gas compressor to supply oil to various parts thereof. Apart of the oil passage 31 communicates with a low pressure portion formed by the gap etc between the rotor shaft 10 and a bearing 10*a* rotatably supporting the same. Flat groove portions 17 are respectively formed in the end surfaces of the front side block 6 and the rear side block 7, and low pressure oil supplying holes 17*a* open into the flat groove portions 17 shown by FIG. 3, the supplying holes 17*a* communicating with the bearing 10*a* through an oil supplying passage.

The configuration and arrangement positions of the flat groove portions 17 are determined such that they communicate with the vane back pressure chambers 14 in the suction and compression strokes of the vanes 15 depending upon the rotating position of the rotor 11, and the flat groove portions 17 together with the back pressure chambers 14 define a back pressure space. The other portion of the oil passage 31 communicates with high pressure oil supplying holes 18*a* formed in the inner surface of the rear side block 7 so that oil may be supplied without passing through the gap between the rotor shaft 10 and the bearing. The section from the oil sump 30 side opening of the oil passage 31 to the high pressure oil supplying holes 18*a* constitutes a first high pressure oil passage. The configuration and arrangement positions of the high pressure oil supplying holes 18*a* are determined such that they communicate with the vane back pressure chambers 14 in the discharge stroke of the vanes 15 depending upon the rotating position of the rotor 11. Further, the flat groove portions 17 and the high pressure oil supplying holes 18*a* are formed in a positional relationship which establishes no communication between them through the back pressure chambers 14 rotating with the rotation of the rotor 11.

Figure 4:
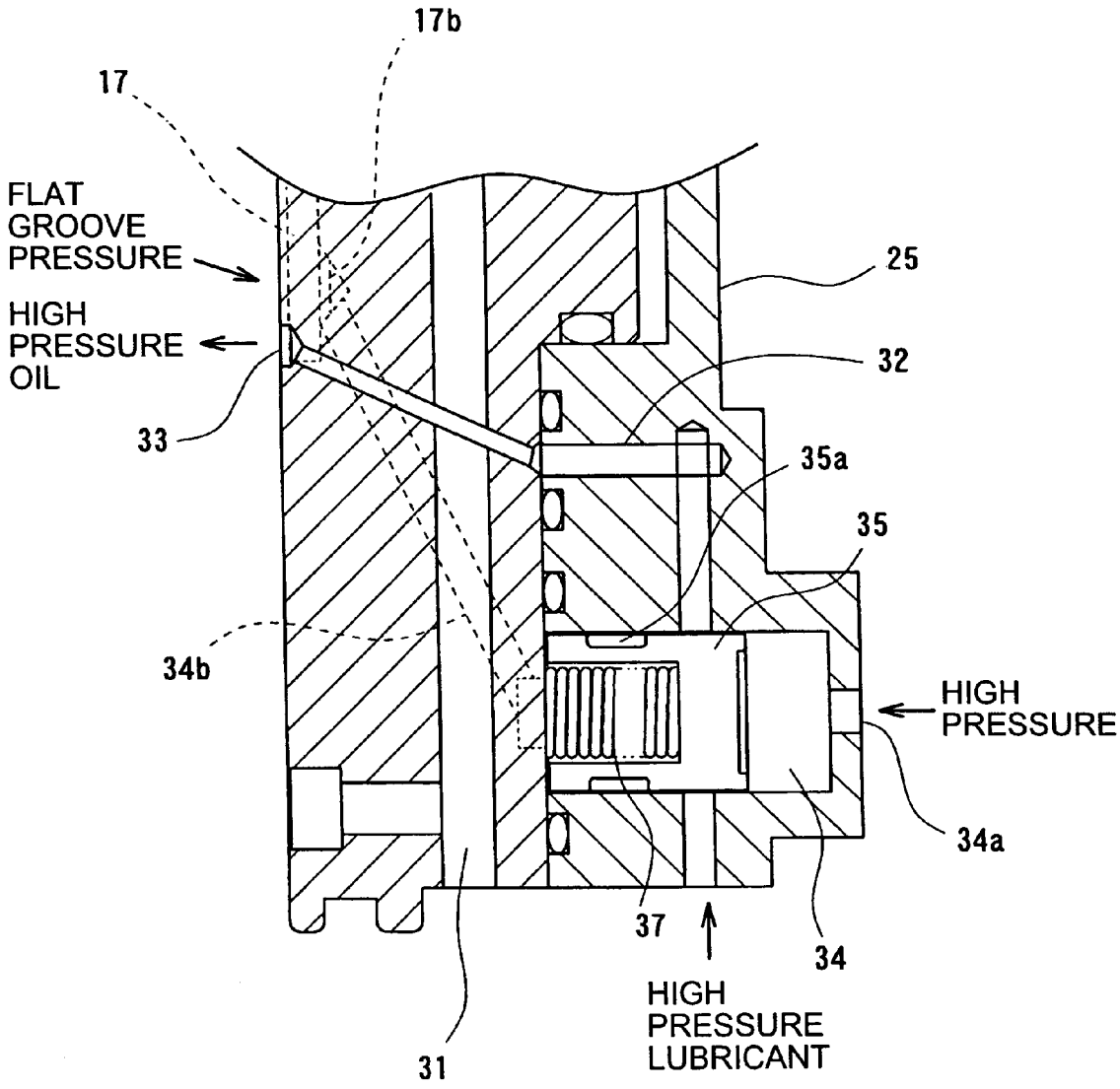
FIG. 4 is a partially enlarged front sectional view of a part of FIG. 3, with the opening/closing valve in the closed state.

As shown in FIG. 4, a part of the oil passage 31 forming a high pressure oil supplying support passage 32 as a second high pressure oil passage extends on the inner surface side of the rear side block, and the forward end thereof opens in the inner surface of the rear side block as a high pressure oil supplying support hole 33. The high pressure oil supplying support hole 33 is formed at a position where it communicates with the flat groove portions 17 through the back pressure chambers 14 when the back pressure chambers 14 rotate.

Figure 5:
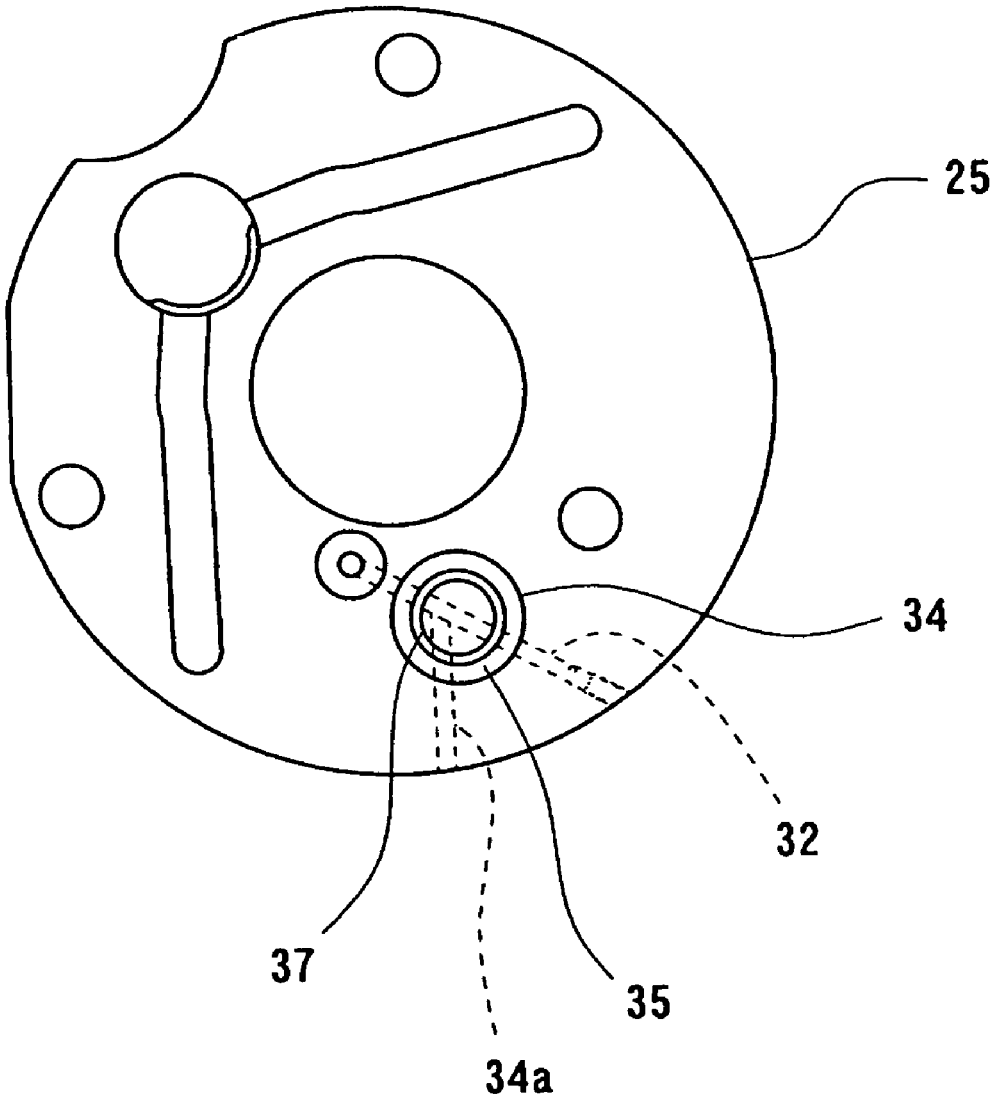
FIG. 5 is a side view showing the inner side of an oil separating block of the first embodiment of the present invention.

As shown in FIGS. 4 and 5, the high pressure oil supplying support passage 32 has in the oil separating block 25 a valve hole 34 extending in a direction crossing the supplying passage 32, and a spool-shaped spool valve element 35 with a communication groove 35*a* in the outer peripheral surface thereof is arranged movably in the valve hole 34. Connected to the valve hole 34 on one end surface side of the spool valve element 35 is a high pressure oil supplying passage 34*a* so that the pressure of high pressure oil may be imparted thereto, and connected to the valve hole 34 on the other end surface side of the spool valve element 35 is a middle pressure oil intake passage 34*b* communicating with a middle pressure oil intake hole 17*b* open into the flat groove portions 17. That is, the differential pressure of the high pressure oil and the middle pressure oil is applied to the spool valve element 35. Further, a coil spring 37 imparting an elastic force to the spool valve element 35 against the high oil pressure is arranged in the valve hole 34 as an elastic member. The pressure-responsive opening/closing valve of the present invention is constructed as described above.

Figure 3:
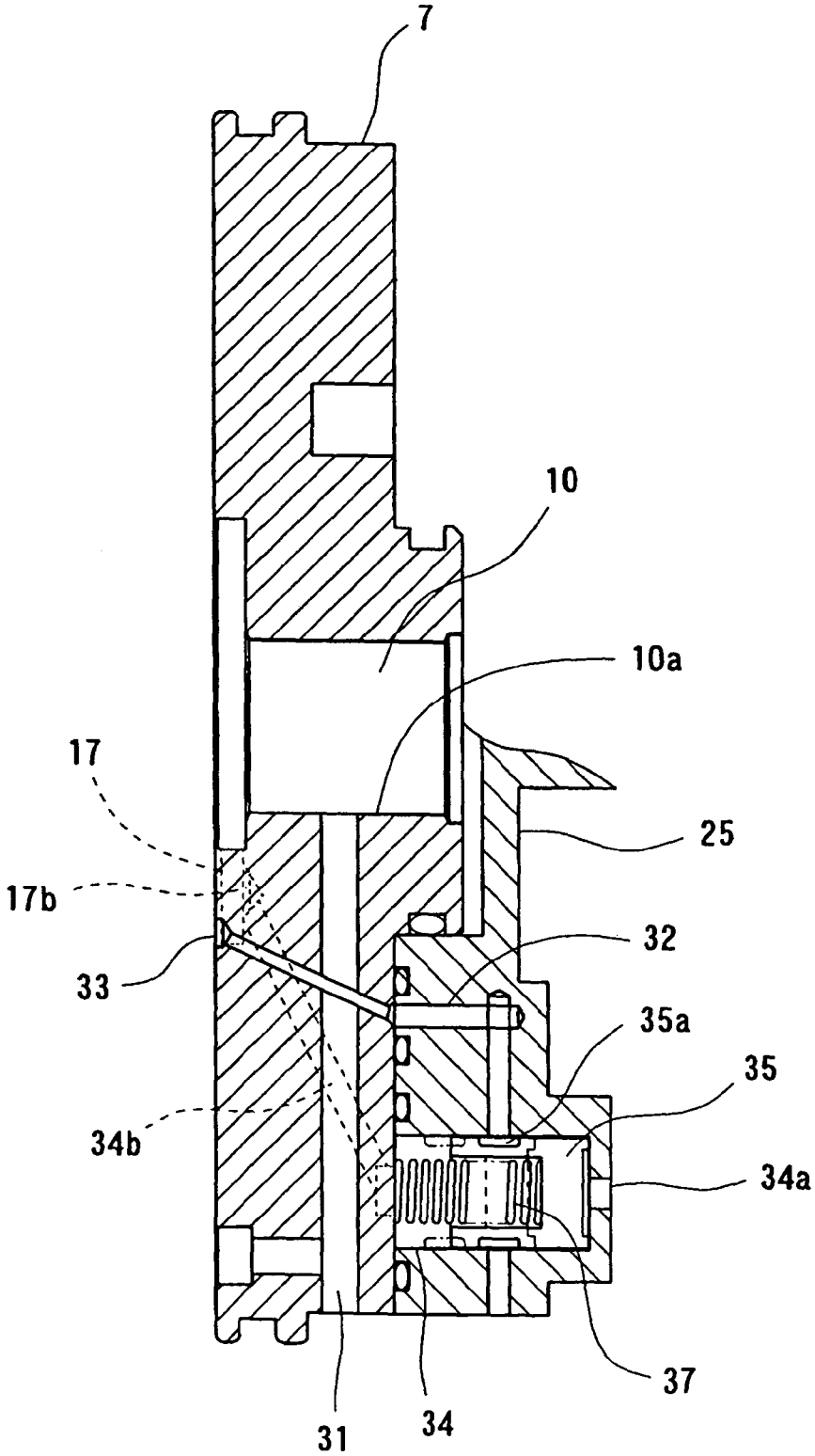
FIG. 3 is a front sectional view of a portion of the first embodiment around an opening/closing valve in the open state.

In the above opening/closing valve, when the spool valve element 35 moves to the left as seen in FIG. 3 by the pressure of the high pressure oil (>low pressure oil) the communication between the high pressure oil supplying support passage 32 and the communication groove 35*a* is canceled, and the high pressure oil supplying support passage 32 is closed. On the other hand, when the spool valve element 35 moves to the right as seen in FIG. 3 by the elastic force (expanding force) of the coil spring 37, communication is established between the high pressure oil supplying support passage 32 and the communication groove 35*a*, and the high pressure oil supplying support passage 32 is opened.

In the above-described gas compressor, when the rotor 11 is rotated around the rotor shaft 10, the volume of the cylinder compression chambers 16 varies, and refrigerant gas is introduced into the cylinder compression chambers 16 through the suction port 2 and the suction chamber 4. At the start or during low speed operation when the RPM of the rotor 11 is low, the high pressure oil and the low pressure oil are of equal pressure or the differential pressure thereof is small. Thus, the spool valve element 35 of the opening/closing valve moves to a position where the high pressure oil supplying support passage 32 is opened by the elastic force of the coil spring 37, that is, the position where communication is established between the high pressure oil supplying support passage 32 and the communication groove 35*a*. Due to this communication, high pressure oil is supplied to the high pressure oil supplying support hole 33 through the high pressure oil supplying support passage 32.

In the above-described condition, as the rotor 11 rotates, middle pressure oil is supplied from the flat groove portions 17 to the back pressure chambers 14 during the transition of the vanes from the suction to the compression stroke, and, in the discharge stroke, high pressure oil is supplied from the high pressure oil supplying holes 18*a* to the back pressure chambers 14. Further, during the transition from the compression to the discharge stroke, high pressure oil is supplied from the high pressure oil supplying support hole 33 to the back pressure chambers 14. At this time, the back pressure chambers 14 temporarily communicate with the high pressure oil supplying support hole 33, and also with the flat groove portions 17, with communication being established between the high pressure oil supplying support hole 33 and the flat groove portions 17 through the back pressure chambers 14. As a result, high pressure oil flows into the flat groove portions 17 from the high pressure oil supplying support hole 33 through the back pressure chambers 14, and the pressure of the oil in the flat groove portions 17 increases. Thus, in the process in which oil is supplied form the flat groove portions 17 to the back pressure chambers 14 of the back pressure space, the pressure imparted is increased, and the extruding force for the vanes 15 is strengthened, whereby even at the initial start of the gas compressor, the vanes 15 project quickly to enable the compressor to function at an early stage, and noise generation due to chattering is also prevented. Further, even during low speed rotation of the rotor 11, it is possible to impart proper extruding force to the vanes 15, and to prevent noise generation due to chattering at the same time.

On the other hand, upon transition to normal operating condition, the difference in pressure between the high pressure oil and the low pressure oil increases, and the pressure of the high pressure oil acts heavily on the spool valve element 35, causing the spool valve element 35 to move forward against the elastic force of the coil spring 37. With this movement, the communicating portion between the high pressure oil supplying support passage 32 and the communication groove 35*a* decreases gradually, until the communication between them is canceled and the high pressure oil supplying support passage 32 is closed by the outer peripheral wall of the spool valve element 35, whereby the supply of high pressure oil to the high pressure oil supplying support hole 33 is stopped. When the rotor 11 rotates in this condition, only middle pressure oil is supplied from the flat groove portions 17 to the back pressure chambers 14 during transition from the suction to the compression stroke, and, in the discharge stroke, only high pressure oil is supplied from the high pressure oil supplying holes 18*a* to the back pressure chambers 14. During normal operation, the pressure of the middle pressure oil is also increased, and large centrifugal force is applied to the vanes 15, so that the extruding force for the vanes 15 during transition from the suction to the compression stroke is large enough. Thus, during the transition from the suction to the compression stroke, it is possible to appropriately reduce the extruding force for the vanes 15 to reduce the operational load. On the other hand, in the compression stroke, the extruding force for the vanes 15 is sufficiently strong due to the effect of the high pressure oil, making it possible to reliably bring the vanes 15 into contact with the inner surface of the cylinder 5.

The refrigerant gas thus compressed in the cylinder compression chambers 16 is discharged in the discharge stroke through the discharge holes 20 to the exterior of the cylinder compression chambers 16, and discharged to the oil separating block 25 through the first discharge chambers 21. Thereafter, as in the prior art, oil is separated by the oil separator 26, and discharged into the discharge chamber 8, and, further, discharged into external piping through the discharge port 9. The oil separated by the oil separator 26 gathers in the oil sump 30, and attains high pressure under the pressure of the refrigerant gas discharged as described above before it is supplied to various portions of the gas compressor through the oil passage 31.

Figure 6:
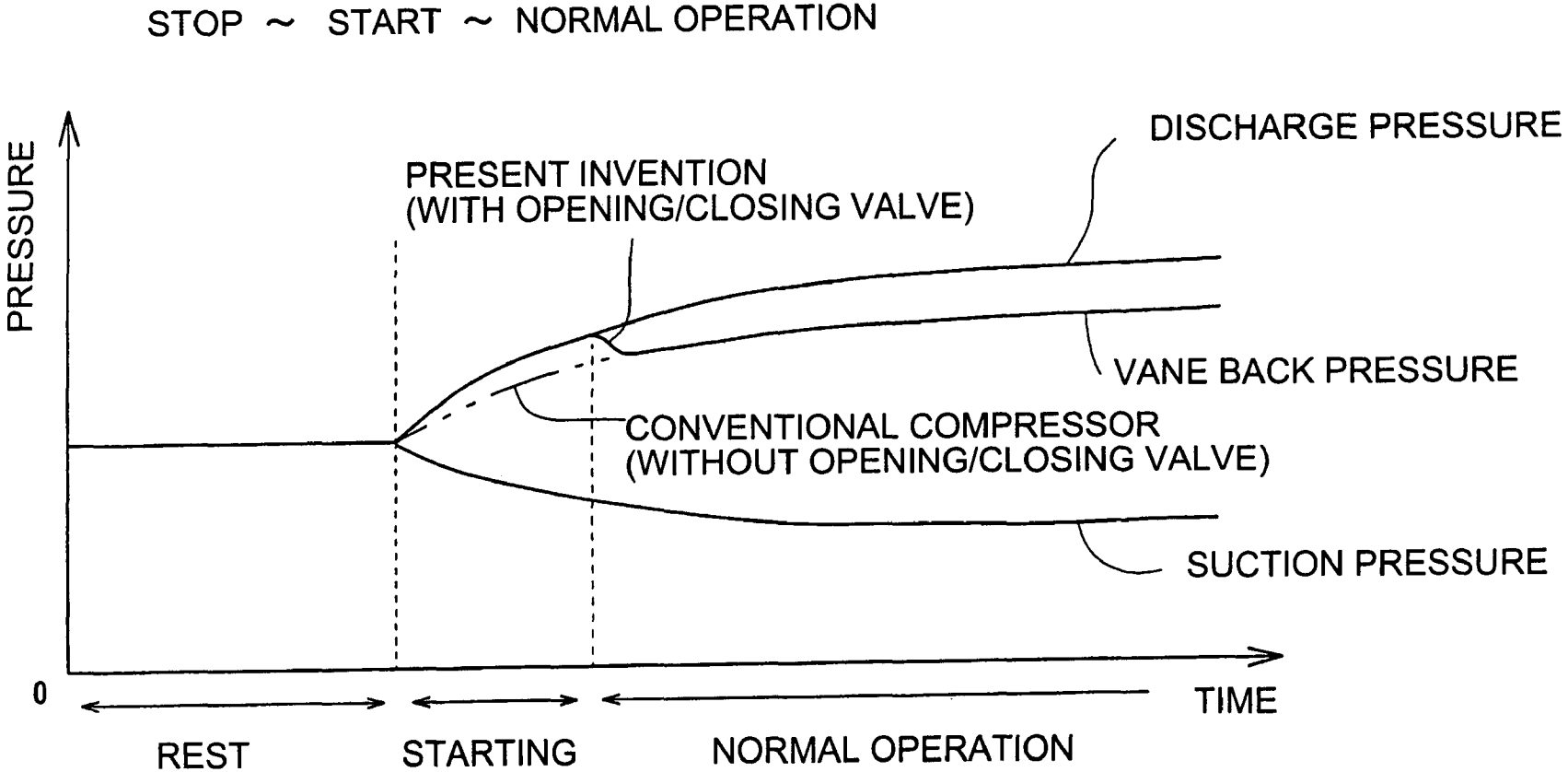
FIG. 6 is a graph showing changes in pressure in gas compressors of the present invention.

FIG. 6 is a graph showing changes in discharge pressure, back pressure chamber pressure, and suction pressure in the above-described gas compressor and a conventional gas compressor. The back pressure chamber pressure shown is that in the suction and compression stroke. In the conventional gas compressor, the discharge pressure and the back pressure chamber pressure increase gradually from the start. Thus, as can be seen, at the start, the pressure in the back pressure chambers is not sufficient, and the problem as mentioned above is involved. In contrast, in the gas compressor of the present invention, the discharge pressure and the back pressure increase similarly from the start by the operation of the opening/closing valve, and there is little or no difference in pressure between them. When the rotating speed of the rotor gradually increases from the start until transition to normal rotation, the pressure of the back pressure chambers gradually decreases by closing the opening/closing valve, so that, during normal operation, a back pressure chamber pressure equal to that of the conventional gas compressor is attained. Thus, as can be seen, at the start, the pressure in the back pressure chambers increases to increase the extruding force for the vanes; upon transition to normal operation, the back pressure chamber pressure for the vanes decreases, making it possible to obtain a power reducing effect as in the prior art.

(Second Embodiment)

Figure 8:
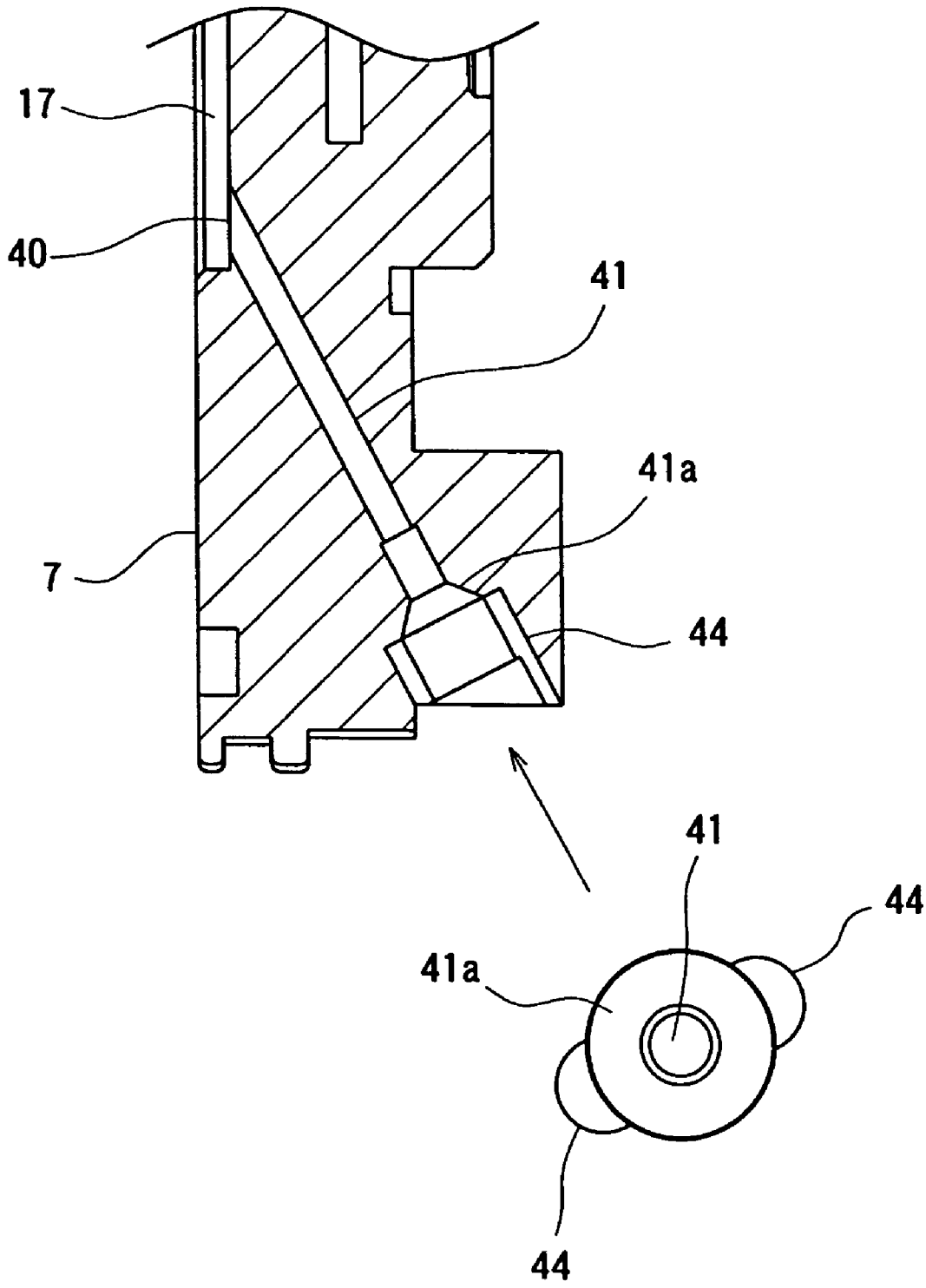
FIG. 8 is a partially enlarged front sectional view showing a portion of the same around the opening/closing valve and a front view of a supplying passage.
Figure 9A:
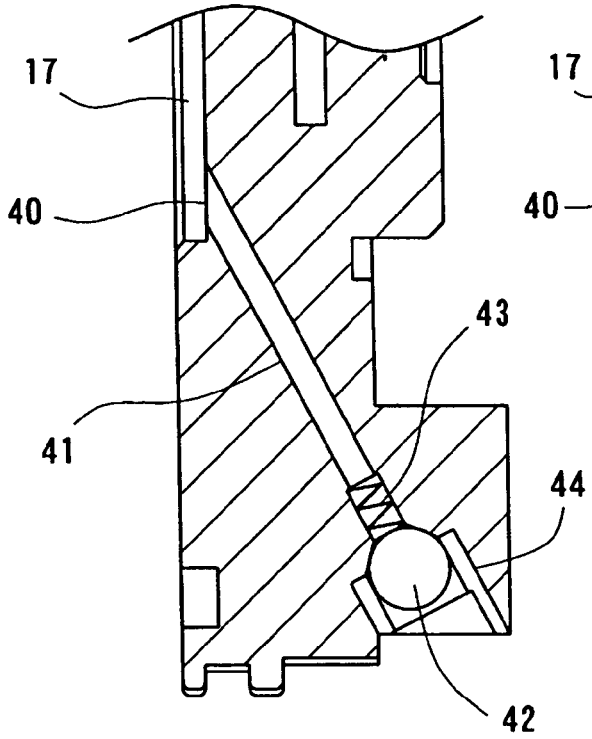
FIGS. 9A and 9B are a portion of the same around the opening/closing valve of the second embodiment.

Next, a second embodiment, in which the construction of the opening/closing valve and the construction of the second high pressure oil passage are modified, will be described with reference to FIGS. 7 through 9. The components which are the same as those of the first embodiment and of the conventional gas compressor are indicated by the same reference numerals, and a description thereof will be abridged or omitted.

Figure 7:
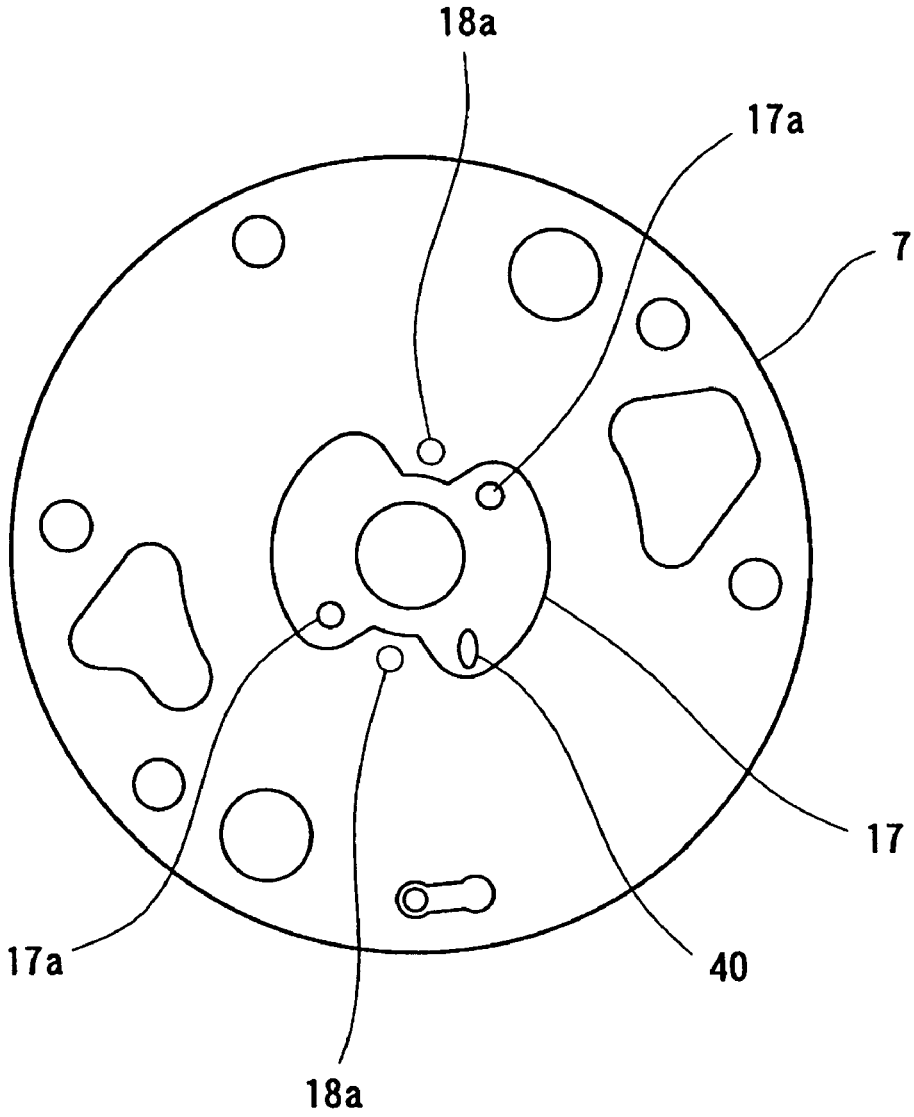
FIG. 7 is a side view of the inner side of the rear side block in accordance with a second embodiment of the present invention.

As in the above embodiment, as shown in FIG. 7, formed in the rear side block 7 are the flat groove portions 17, the low pressure oil supplying holes 17*a*, and the high pressure oil supplying holes 18*a*, with a high pressure oil supplying support hole 40 opening into the flat groove portions 17. A high pressure oil supplying support passage 41, to which high pressure oil is supplied, is connected to the high pressure oil supplying support hole 40, forming the second high pressure oil passage. Arranged inside the high pressure oil supplying support passage 41 is a ball valve element 42 movable along the high pressure oil supplying support passage 41. Through abutment and separation of the spherical surface of the ball valve element 42 and a conical portion 41*a* on the flat groove portion 17 side formed in the high pressure oil supplying support passage 41, the opening and closing of the high pressure oil supplying support passage 41 are effected. Installed in the high pressure oil supplying support passage 41 is a coil spring 43 which has an elastic force to be applied to the ball valve element 42 so as to move the ball valve element 42 away from the conical portion 41*a*. Further, the pressure of the oil in the flat groove portions 17 is applied to one end surface side (flat groove portion side) of the ball valve element 42, and the pressure of the high pressure oil is applied to the other end surface side thereof. The opening/closing valve is constructed as described above. Further, formed in the peripheral wall of the high pressure oil supplying support passage 41 accommodating the ball valve element 42 is a flow support passage 44 (see FIG. 8) extending along the high pressure oil supplying support passage 41, and viscous oil passes around the ball valve element 42 to smoothly flow to the flat groove portion 17 side.

Figure 9B:
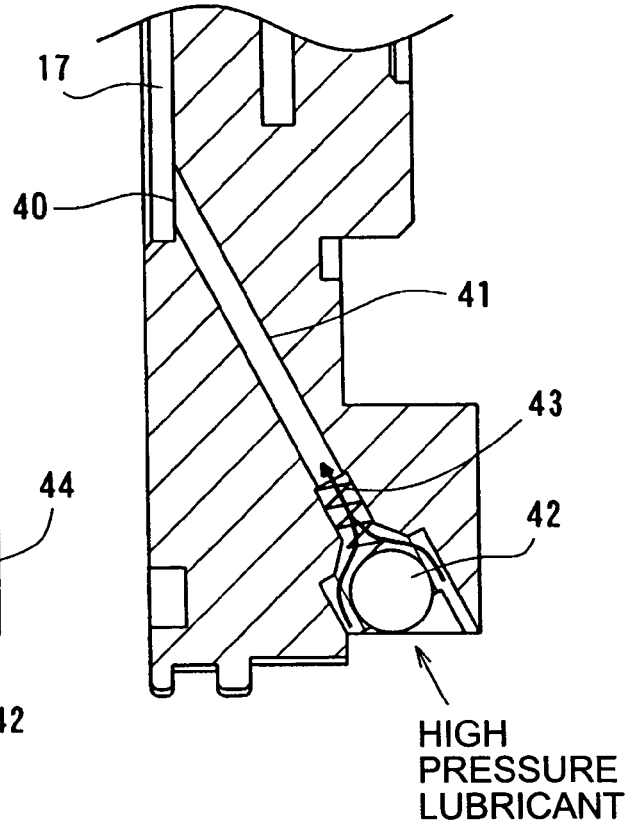

As in the first embodiment, in this second embodiment also, the high pressure oil and the low pressure oil are of equal pressure or exhibit little difference in pressure between them at the start and during low speed operation, so that the ball valve element 42 is separated from the conical portion 41*a* to move to the position where the high pressure oil supplying support passage 41 is opened (see FIG. 9B). Due to this communication, high pressure oil is supplied to the flat groove portions 17 through the high pressure oil supplying support passage 41, whereby even during transition of the vanes from the suction to the compression stroke, high pressure oil is supplied from the flat groove portions 17 to the back pressure chambers 14, and the extruding force for the vanes is enhanced, with the projectability of the vanes 15 being improved. Further, due to the enhancement of the extruding force, it is also possible to prevent noise generation due to chattering.

On the other hand, upon transition to the normal operation state, the difference in pressure between the high pressure oil and the low pressure oil increases, and the pressure of the high pressure oil acts heavily on the ball valve element 42, causing the ball valve element 42 to move to the conical portion 41*a* side against the elastic force of the coil spring 43. As a result, the conical portion 41*a* and the spherical surface of the ball valve element 42 are brought into contact with each other, and the high pressure oil supplying support passage 41 is sealed by the spherical surface, whereby the supply of high pressure oil to the flat groove portions 17 is stopped (see FIG. 9A). As in Embodiment 1 described above, in this state, only low pressure oil is supplied from the flat groove portions 17 to the back pressure chambers during transition from the suction to the compression stroke, and, in the discharge stroke, only high pressure oil is supplied from the high pressure oil supplying holes 18*a* to the back pressure chambers. As a result, in the normal operation state, it is possible to reduce the operational load, and in the compression stroke, it is possible to reliably bring the vanes into contact with the cylinder inner surface.

While in the above-described embodiments the supply of high pressure oil in the high pressure oil supplying support portion is effected from an appropriate oil supplying passage, there is no particular limitation regarding the supply source; for example, it is also possible to use high pressure oil accumulated in the cylinder compression chambers as the supply source.

As described above, in accordance with the present invention, there is provided the gas compressor having the compressor main body which sucks, compresses, and discharges refrigerant gas, and the oil sump for storing oil for lubricating the compressor main body. The compressor main body is composed of the cylinder, the side blocks arranged at the axial ends of the cylinder, the rotor rotatably arranged in the cylinder, the vane grooves formed so as to extend inwardly from the outer peripheral surface toward the inner periphery of the rotor, and the vanes slidably disposed in the vane grooves for slidably advancing and retracting during rotation of the rotor. The compressor main body includes the back pressure chambers including the bottom portions of the vane grooves and attaining the middle pressure between suction pressure and discharge pressure during normal operation of the compressor main body; the first high pressure oil passage establishing communication between the oil sump and the bottom portions of the vane grooves when the vanes are at their discharge stroke positions; the second high pressure oil passage establishing communication between the oil sump and the back pressure chambers; and the opening/closing valve for opening and closing the second high pressure oil passage, whereby exclusively at the start or during low speed operation, high pressure oil is supplied to the back pressure chambers in the stroke in which middle pressure oil is supplied to the back pressure chambers to thereby improve vane projectability, making it possible to cause the compressor to function at an early stage and to effectively prevent chattering. And, during normal operation, by stopping the supply of high pressure oil through operation of the opening/closing valve, an operational load reducing effect is obtained in the stroke in which only middle pressure fluid is supplied to the back pressure chambers.

What is claimed is:

1. A gas compressor comprising:

a compressor main body which sucks, compresses, and discharges refrigerant gas, and an oil sump which stores oil for lubricating the compressor main body, the compressor main body being composed of a cylinder, side blocks disposed at axial ends of the cylinder, a rotor rotatably mounted to undergo rotation in the cylinder, vane grooves extending inwardly from an outer peripheral surface of the rotor toward an inner periphery thereof, and vanes slidable in respective ones of the vane grooves for slidably advancing and retracting during rotation of the rotor;

a back pressure space including bottom portions of the vane grooves and attaining a middle pressure between a suction pressure and a discharge pressure during normal operation of the compressor main body;

a first high pressure oil passage establishing communication between the oil sump and the vane groove bottom portions when the vanes are at their discharge stroke positions;

a second high pressure oil passage establishing communication between the oil sump and the back pressure space; and an opening/closing valve for opening and closing the second high pressure oil passage.

2. A gas compressor according to claim 1; wherein the opening/closing valve keeps the second high pressure oil passage open when the rotation of the rotor is at rest, closes the second high pressure oil passage when the rotor starts rotation, and keeps the second high pressure oil passage closed during normal operation of the compressor.

3. A gas compressor according claim 1; wherein the opening/closing valve keeps the second high pressure oil passage closed during normal operation of the compressor and keeps the second high pressure oil passage open when the compressor is not performing normal operation and the oil pressure is low.

4. A gas compressor according to claim 1; wherein the back pressure space has a flat groove communicating with the vane groove bottom portions when the vanes are at their positions in transition from suction stroke to compression stroke, and the vane groove bottom portions communicate with the first high pressure oil passage after the communication between the flat groove and the vane groove bottom portions is interrupted.

5. A gas compressor according to claim 1; wherein a downstream end portion of the second high pressure oil passage opens into the vane groove bottom portions when the vanes are situated at their discharge stroke positions.

6. A gas compressor according to claim 4; wherein a downstream end portion of the second high pressure oil passage opens into the flat groove.

7. A gas compressor according to claim 1; wherein the opening/closing valve is movably arranged so as to open and close the second high pressure oil passage and has a valve element situated at a position where the valve element closes the second high pressure oil passage and an elastic member for imparting an elastic force to the valve element to place the valve element at a position where the valve element opens the second high pressure oil passage, the valve element moving under a pressure of high pressure oil to a position where the valve element closes the second high pressure oil passage during normal operation of the compressor and moving to a position where the valve element opens the second high pressure oil passage by the elastic force of the elastic member when the pressure of the high pressure oil is lowered.

8. A gas compressor according to claim 7; wherein a differential pressure of the high pressure oil to which the discharge pressure in the compressor is imparted and middle pressure oil is applied to the valve element.

9. A gas compressor comprising: a housing having an oil sump for storing oil and supplying oil under pressure during use of the gas compressor; a cylinder disposed in the housing and having a generally elliptical inner peripheral surface; a rotationally driven rotor rotatably disposed in the cylinder; vane grooves formed in the rotor and extending inwardly from an outer peripheral surface of the rotor; vanes slidably disposed in respective ones of the vane grooves and cooperating with the inner peripheral surface of the cylinder and the outer peripheral surface of the rotor to define compression chambers for intaking a gas, compressing the gas and discharging compressed gas during rotation of the rotor; means including bottom portions of the vane grooves for defining a back pressure space; a first high pressure oil passage establishing communication between the oil sump and the vane groove bottom portions when the vanes are at their discharge stroke positions; a second high pressure oil passage establishing communication between the oil sump and the back pressure space; and a valve that opens the second high pressure oil passage during periods of start-up and low speed operation of the gas compressor and closes the second high pressure oil passage during periods of normal speed operation of the gas compressor.

10. A gas compressor according to claim 9; wherein the back pressure space comprises a flat groove that communicates with the bottom portions of the vane grooves when the vanes are at their positions in transition from suction stroke to compression stroke, and the bottom portions of the vane grooves communicate with the first high pressure oil passage after the communication between the flat groove and the vane groove bottom portions is interrupted.

11. A gas compressor according to claim 10; wherein a downstream end portion of the second high pressure oil passage opens into the vane groove bottom portions when the vanes are situated at their discharge stroke positions.

12. A gas compressor according to claim 11; wherein a downstream end portion of the second high pressure oil passage opens into the flat groove.

13. A gas compressor according to claim 10; wherein a downstream end portion of the second high pressure oil passage opens into the flat groove.

14. A gas compressor according to claim 9; wherein a downstream end portion of the second high pressure oil passage opens into the vane groove bottom portions when the vanes are situated at their discharge stroke positions.

15. A gas compressor according to claim 9; wherein the back pressure space comprises a flat groove that communicates with the bottom portions of the vane grooves when the vanes are at their positions in transition from suction stroke to compression stroke, and a downstream end portion of the second high pressure oil passage opens into the flat groove.

16. A gas compressor according to claim 9; wherein the valve comprises a pressure-responsive valve movable to a first position to close the second high pressure oil passage during periods of normal speed operation of the gas compressor when the differential pressure of oil supplied from the oil sump and oil in the back pressure space is greater than a certain level and movable to a second position to open the second high pressure oil passage during periods of start-up and low speed operation of the gas compressor when the differential pressure of oil supplied from the oil sump and oil in the back pressure space is less than the certain level.

17. A gas compressor according to claim 16; wherein the pressureresponsive valve comprises a valve spool element movable between the first and second positions, a spring that urges the valve spool element toward the second position, and means for applying the differential pressure to opposite ends of the valve spool element.

* * * * *